US010435832B2

(12) United States Patent
Hwang

(10) Patent No.: US 10,435,832 B2
(45) Date of Patent: Oct. 8, 2019

(54) WASHING MACHINE

(71) Applicant: Dongbu Daewoo Electronics Corporation, Seoul (KR)

(72) Inventor: Ui Kun Hwang, Seoul (KR)

(73) Assignee: DONGBU DAEWOO ELECTRONICS CORPORATION, Seoul (KR)

( * ) Notice: Subject to any disclaimer, the term of this patent is extended or adjusted under 35 U.S.C. 154(b) by 118 days.

(21) Appl. No.: 15/499,768

(22) Filed: Apr. 27, 2017

(65) Prior Publication Data

US 2018/0087204 A1 Mar. 29, 2018

(30) Foreign Application Priority Data

Sep. 27, 2016 (KR) ..... 10-2016-0124310

(51) Int. Cl.
*D06F 35/00* (2006.01)
*D06F 17/06* (2006.01)

(52) U.S. Cl.
CPC ..... *D06F 35/002* (2013.01); *D06F 17/06* (2013.01)

(58) Field of Classification Search
CPC ..... D06F 17/06; D06F 35/002; F17C 2205/0332; F17C 2205/0335; B01F 3/0473
See application file for complete search history.

(56) References Cited

U.S. PATENT DOCUMENTS 3,003,346 A * 10/1961 Morris ..... D06F 39/10 134/109
7,255,332 B2 * 8/2007 Osborn ..... B01F 3/0473 210/221.2
9,060,916 B2 * 6/2015 Cunningham ..... A61H 33/6036
2009/0266115 A1 * 10/2009 Cao ..... D06F 39/007 68/13 A
2010/0179461 A1 * 7/2010 Cunningham ..... A01K 13/001 601/154
2010/0199421 A1 * 8/2010 Moon ..... A23N 12/02 4/602
2012/0159716 A1 * 6/2012 Lee ..... D06F 35/002 8/137
2015/0176170 A1 * 6/2015 Bae ..... D06F 35/002 68/183
2016/0305059 A1 * 10/2016 Xu ..... D06F 39/08

* cited by examiner

*Primary Examiner* — Joseph L. Perrin

(57) ABSTRACT

An exemplary embodiment of the present disclosure relates to a washing machine including a dissolving unit, and the dissolving unit includes: an outer body which is formed to have a hollow interior, and has one side formed to be opened, and the other side having a drain hole; a dissolving cap which is coupled to one side of the outer body so as to store air therein, and has a dissolving inlet port formed to supply water supplied from the outside into the inner body; and a discharge check valve which is installed at the other side of the outer body, and opens and closes the drain hole.

9 Claims, 6 Drawing Sheets

WASHING MACHINE

CROSS-REFERENCE TO RELATED APPLICATIONS

This application claims benefit and priority to Korean Patent Application No. 10-2016-0124310, filed on Sep. 27, 2016, with the Korean Intellectual Property Office, the disclosure of which is incorporated herein in its entirety by reference.

TECHNICAL FIELD

An exemplary embodiment of the present invention relates to a washing machine, and more particularly, to a washing machine which dissolves stored air in water, introduced from outside in order to supply bubbles during a laundry washing cycle.

BACKGROUND

In general, a washing machine washes laundry by using friction between water and laundry where the friction is caused by a rotation of a pulsator installed in a washing tub. Specifically, a plurality of holes is formed in an outer circumferential surface of the washing tub which is positioned inside of the tub, such that water introduced into the tub is also introduced into the washing tub and water in the washing tub is discharged into the tub for eventual discharge to a drain line. That is, during the processes of a washing process, a rinsing process, and a spin-drying process, the water in the tub is discharged to the outside of the tub through a drain line installed at a lower side of the tub.

Therefore, the laundry accommodated in the washing tub is washed by the rotation of the pulsator, the rotation of the washing water stored in the tub, and the washing tub, and contact between the water and the laundry.

However, when detergent or foreign substances which may remain on surfaces of the laundry are left on the laundry when worn, dermatitis (such as atopic dermatitis) may be caused when a user repeatedly wears the clothes.

To prevent this problem, various technologies for supplying small amounts of washing water to the surfaces of the laundry are applied, but there is a problem in that a separate device needs to be installed, such as a pump for creating the small amounts of washing water. In this case, there are problems due to noise associated with the operation of the pump and there is difficulty regarding the maintenance of the pump over time when the pump is repeatedly used.

In the case in which the washing water remains in certain devices required for supplying the small amounts of washing water during winter, for instance, there is a problem in that these devices may become frozen.

SUMMARY

The embodiments of the present disclosure have been made in an effort to provide a washing machine including a dissolving unit capable of allowing a discharge check valve to be easily assembled, and to effectively discharge any water remaining in the washing machine.

An exemplary embodiment of the present disclosure provides a washing machine including a dissolving unit, in which the dissolving unit includes: an outer body which is formed to have a hollow interior, and has one side formed to be opened, and the other side having a drain hole; a dissolving cap which is coupled to one side of the outer body to store air therein, and has a dissolving inlet port formed to supply water supplied from the outside into the inner body; and a discharge check valve which is installed at the other side of the outer body, wherein the discharge check valve opens and closes the drain hole.

The outer body may include a valve accommodating protrusion which surrounds the drain hole and protrudes to the outside in the longitudinal direction of the outer body in one area of the other side of the outer body.

The discharge check valve may include: a valve member which has one end portion inserted into the drain hole, and the other end portion disposed in the valve accommodating protrusion; a valve cover member which is detachably coupled to an outer circumferential surface of the valve accommodating protrusion, and has a dissolving drain port that guides the water passing through the drain hole so that the water is discharged to the outside of the outer body; and an elastic member which is disposed between the valve member and the valve cover member, and provides elastic force to the valve member.

The valve member may include a valve hollow portion formed at a center of one end portion inserted into the drain hole, and an outer diameter of the one end portion may be larger than a diameter of the drain hole based on the valve hollow portion.

An outer diameter of the other end portion of the valve member, which is disposed in the valve accommodating protrusion, may be larger than a diameter of the drain hole, and the valve member may include a support groove formed at the other end portion so as to support the elastic member.

The valve cover member may include a catching protrusion which is formed to be spaced apart from the dissolving drain port and supports the elastic member.

The valve cover member may further include a valve rib which is disposed between the catching protrusion and a cover outer wall coupled to an outer circumferential surface of the valve accommodating protrusion and protrudes toward the outer body based on the dissolving drain port.

The discharge check valve may further include a first sealing member which is installed between the cover outer wall and the valve rib, and maintains a water tight seal between the valve accommodating protrusion and the valve cover member.

The outer body may include support protrusions which face the other end portion of the valve member, and are spaced apart from each other with respect to the drain hole, wherein the support protrusions protrude in the longitudinal direction of the outer body, and support an opened state of the drain hole.

The dissolving unit of the washing machine may further include: an inner body which is opened at one side and disposed in the outer body such that an outer circumferential surface of the inner body is spaced apart from an inner circumferential surface of the outer body to form a dissolving flow path; a porous portion which is formed at one side of the inner body; and an inner hole which is formed at the other side of the inner body and guides any water remaining in the inner body so that the water is discharged to the drain hole.

Alternatively, the discharge check valve may include: a valve member which has one end portion that has a relatively larger diameter compared to the drain hole and is disposed in the drain hole, and the other end portion of the valve member is disposed outside the drain hole; and an elastic member which is disposed between the drain hole and one end portion of the valve member and provides elastic force to the valve member.

Another exemplary embodiment of the present disclosure provides a washing machine including a dissolving unit, in which the dissolving unit includes: an outer body which is formed with a hollow interior, and has one side formed to be opened, and the other side having a drain hole; a dissolving cap which is coupled to one side of the outer body to store air therein, and has a dissolving inlet port formed to supply water supplied from the outside into the inner body; and where the dissolving unit further includes a discharge check valve which opens and closes the drain hole and includes a valve member which is installed at the other side of the outer body and has one end portion inserted and installed into the drain hole and the other end portion disposed outside the drain hole, and where the discharge check valve also includes an elastic member which is installed between the drain hole and one end portion of the valve member and provides elastic force to the valve member.

According to the exemplary embodiments of the present disclosure, the washing machine, including the dissolving unit, may allow the discharge check valve of the dissolving unit to be easily assembled, and may effectively discharge any water remaining in the washing machine.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
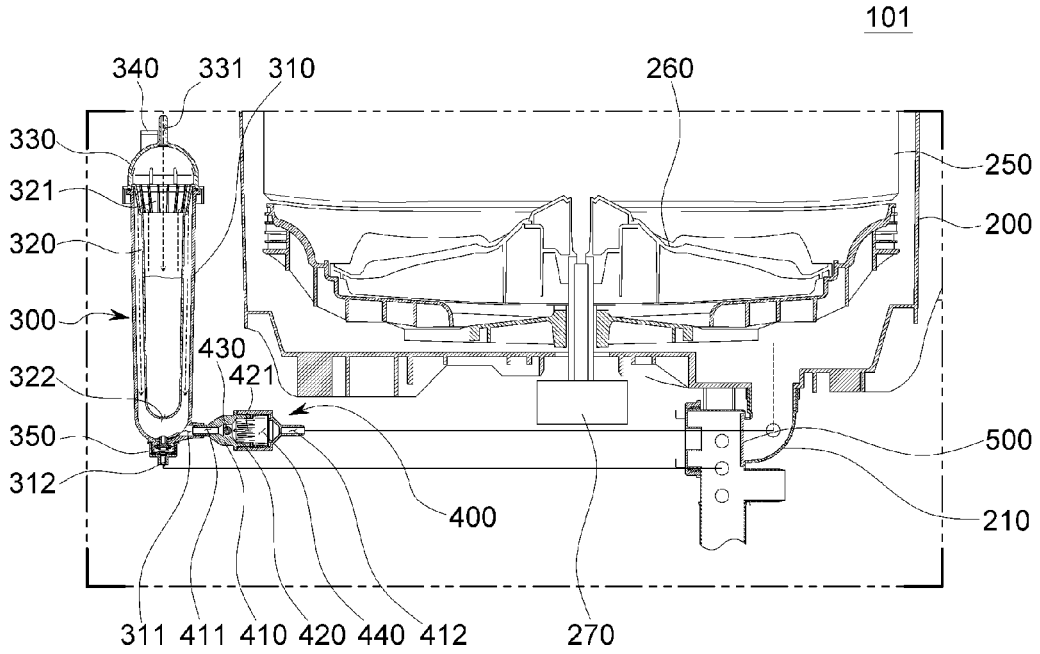
FIG. 1 is a cross-sectional view illustrating a dissolving unit in accordance with embodiments of the present invention.

In the following detailed description, reference is made to the accompanying drawing, which forms a part hereof. The illustrative embodiments described in the detailed description, drawings, and claims are not meant to be limiting. Other embodiments may be utilized, and other changes may be made, without departing from the spirit or scope of the subject matter presented here.

Hereinafter, exemplary embodiments of the present disclosure will be described in detail with reference to the accompanying drawings so that those skilled in the technical field to which the present disclosure pertains may easily carry out the exemplary embodiments. The present disclosure may be implemented in various different ways, and is not limited to the exemplary embodiments described herein.

In several exemplary embodiments, constituent elements having the same configuration will be representatively described using the same reference numerals in one exemplary embodiment, and other exemplary embodiments will be described with regard to only constituent elements that are different from the constituent elements described in one exemplary embodiment.

It is noted that the drawings are schematic, and are not illustrated based on actual scale. Relative dimensions and proportions of parts illustrated in the drawings are exaggerated or reduced in size for the purpose of clarity and convenience in the drawings, and any dimension is merely illustrative but not restrictive. Further, the same reference numerals designate the same structures, elements or components illustrated in two or more drawings in order to exhibit similar characteristics.

Exemplary drawings of the present disclosure illustrate ideal exemplary embodiments of the present disclosure in more detail. As a result, various modifications of the drawings are expected. Therefore, the exemplary embodiments are not limited to specific forms in regions illustrated in the drawings, and for example, include modifications due to manufacturing.

Hereinafter, a washing machine 101 including a dissolving unit 300 according to an exemplary embodiment of the present disclosure will be described with reference to FIGS. 1 to 4.

As illustrated in FIG. 1, the dissolving unit 300 includes an outer body 310, a dissolving cap 330, and a discharge check valve 350.

Air is stored in the dissolving unit 300. In addition, the dissolving unit 300 may dissolve the stored air in water that is supplied from the outside, and then may supply the water to a tub 200 of the washing machine 101. Specifically, the dissolving unit 300 may advantageously supply water with dissolved air into the washing machine.

Figure 2:
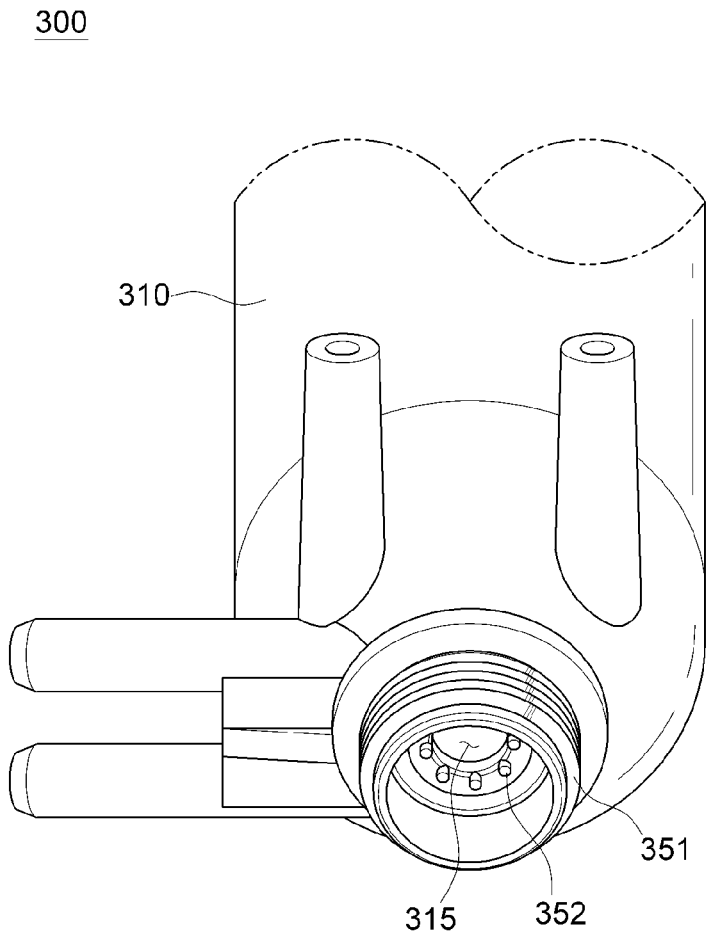
FIG. 2 is a view illustrating a lower portion of an outer body of the dissolving unit in FIG. 1 in accordance with embodiments of the present invention.

As illustrated in FIGS. 1 and 2, the outer body 310 has a hollow interior. In addition, one side of the outer body 310 is opened, and a drain hole 315 is formed at the other side of the outer body 310. Specifically, the outer body 310 has a cross section having approximately a "U" shape, and thus may have space to store a fluid therein. Therefore, a front side at one side of the outer body 310 is completely opened, and the other side of the outer body 310 is formed in a hemispheric shape and may have a drain hole 315 which is relatively smaller than the opened side.

For example, the drain hole 315 may be formed at a lowest side of the other side of the outer body 310.

The dissolving cap 330 is coupled to one side of the outer body 310. In addition, a dissolving inlet port 331 (through which water supplied from the outside is supplied into an inner body 320) may be formed in the dissolving cap 330. Specifically, one side of the dissolving cap 330 which faces one side of the outer body 310 is completely opened, and the other side may be formed in a hemispheric shape. Therefore, air may be effectively stored in an internal area defined by coupling the dissolving cap 330 and the outer body 310.

The water supplied through the dissolving inlet port 331 flows in a longitudinal direction of the outer body 310, and the air stored in the dissolving cap 330 and the outer body 310 may be dissolved in the water that flows as described above.

The discharge check valve 350 is installed at the other side of the outer body 310. In addition, the discharge check valve 350 may open and close the drain hole 315. Specifically, the discharge check valve 350 may be opened or closed in accordance with pressure in the interior defined by coupling the dissolving cap 330 and the outer body 310 or a level of water supplied from the dissolving inlet port 331.

Therefore, since the dissolving unit 300 includes the discharge check valve 350 that may selectively open and close the drain hole 315 formed in the outer body 310, it is possible to prevent the dissolving unit 300 from damage due to any frozen residual water remaining in the dissolving unit 300, for instance, during the winter.

As illustrated in FIG. 2, the outer body 310 of the dissolving unit 300 according to the exemplary embodiment of the present disclosure may include a valve accommodating protrusion 351.

Figure 3:
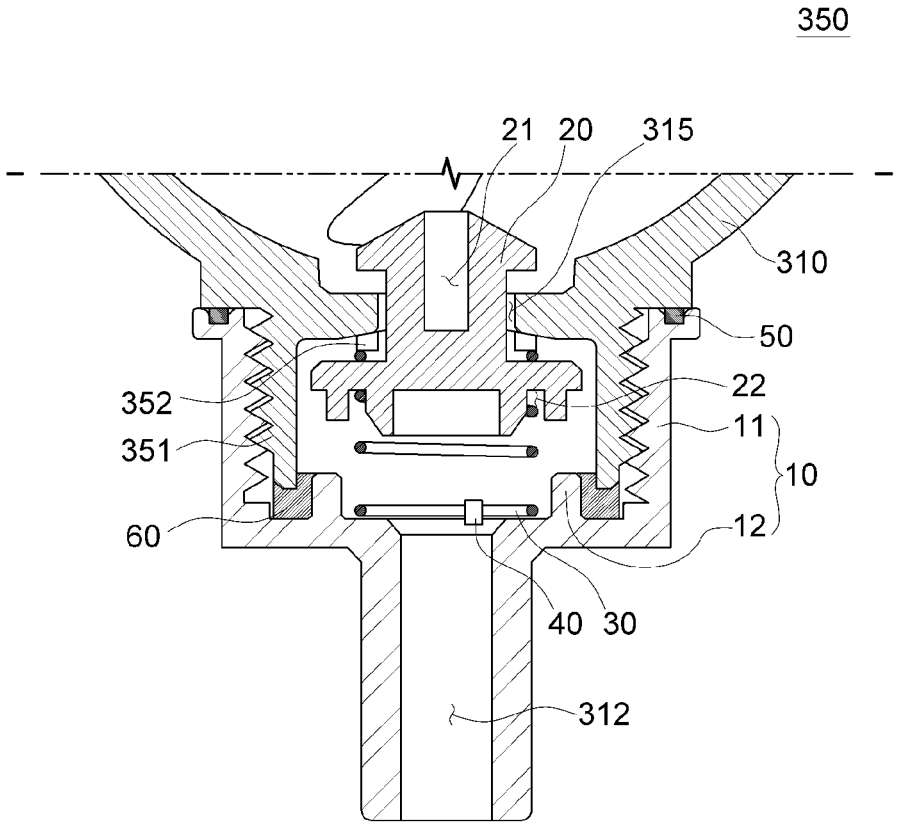
FIGS. 3 and 4 are different views illustrating a state in which the discharge check valve in FIG. 2 operates in accordance with embodiments of the present invention.

The valve accommodating protrusion 351 may be formed to surround the drain hole 315. In addition, the valve accommodating protrusion 351 may protrude in one area of the other side of the outer body 310 toward the outside in the longitudinal direction of the outer body 310. Specifically, the valve accommodating protrusion 351 may protrude in one area of the other side of the outer body 310 so as to surround the drain hole 315. That is, the valve accommodating protrusion 351 may have a hollow portion therein which communicates with the drain hole 315. In addition, as illustrated in FIG. 3, the discharge check valve 350 of the dissolving unit 300 according to the exemplary embodiment of the present disclosure may include a valve member 20, a valve cover member 10, and an elastic member 30.

One end portion of the valve member 20 is inserted into the drain hole 315, and the other end portion is disposed in the valve accommodating protrusion 351. That is, the valve member 20 may selectively open and close the drain hole 315 by using one end portion inserted into the drain hole 315.

The valve cover member 10 may be detachably coupled to an outer circumferential surface of the valve accommodating protrusion 351. In addition, a dissolving drain port 312 may be formed, which guides the water passing through the drain hole 315 so that the water is discharged to the outside of the outer body 310. Specifically, the valve cover member 10 may surround an outer circumferential surface of the valve accommodating protrusion 351, may be detachably coupled to the valve accommodating protrusion 351, and may include the dissolving drain port 312 which is formed in a central portion of the valve cover member 10 and also selectively communicates with the drain hole 315 through the valve member 20.

As an example, screw threads are formed on the outer circumferential surface of the valve accommodating protrusion 351, and other screw threads, which are engaged with the screw threads of the valve accommodating protrusion 351, may be formed on one surface of the valve cover member 10 which faces the outer circumferential surface of the valve accommodating protrusion 351.

The elastic member 30 may be disposed between the valve member 20 and the valve cover member 10. In addition, the elastic member 30 may provide elastic force to the valve member 20. Specifically, the elastic member 30 may provide elastic force so that the valve member 20 opens the drain hole 315.

That is, the elastic member 30 is compressed when the valve member 20 closes the drain hole 315, and is expanded when the valve member 20 opens the drain hole 315.

As illustrated in FIG. 3, the valve member 20 of the dissolving unit 300 according to the exemplary embodiment of the present disclosure includes a valve hollow portion 21, and an outer diameter of one end portion of the valve member 20 may be greater than a diameter of the drain hole 315.

The valve member 20 may include the valve hollow portion 21. The valve hollow portion 21 is a hollow portion formed in a center of one end portion of the valve member 20. Specifically, the valve member 20 includes an elastic member such as rubber, for instance, and thus the valve member 20 may be inserted and installed into the drain hole 315 by being effectively deformed by external force and by the valve hollow portion 21.

Based on the valve hollow portion 21, the outer diameter of one end portion of the valve member 20 may be larger than the diameter of the drain hole 315. Therefore, since the valve member 20 includes the valve hollow portion 21, one end portion of the valve member 20, which has a relatively larger diameter than the drain hole 315, may be effectively inserted and installed into the drain hole 315. That is, since the valve hollow portion 21, formed at a central portion of the valve member 20, may provide a deformable space so that one end portion of the valve member 20 is deformed by external force, then the valve member 20 may be easily assembled when being inserted into the drain hole 315.

An outer diameter of the other end portion of the valve member 20 of the dissolving unit 300 according to an exemplary embodiment of the present disclosure may be larger than the diameter of the drain hole 315. Further, a support groove 22 may be formed at the other end portion of the valve member 20.

An outer diameter of the other end portion of the valve member 20 may be relatively larger than the diameter of the drain hole 315. Specifically, the outer diameter of the other end portion of the valve member 20 may be relatively larger than the outer diameter of one end portion of the valve member 20.

The support groove 22 may be formed at the other end portion of the valve member 20. The support groove 22, which is concavely formed in the longitudinal direction of the valve member 20, may be formed at the other end portion of the valve member 20 which faces the inside of the valve cover member 10 in the longitudinal direction of the valve member 20. Specifically, the support groove 22 may be formed in a ring shape around a center of the valve member 20.

The support groove 22 may support the elastic member 30. Specifically, one side of the elastic member 30 is at least partially inserted into the support groove 22, such that the elastic force exerted by the elastic member 30 may be effectively transmitted to the valve member 20.

As illustrated in FIG. 3, the valve cover member 10 of the dissolving unit 300 according to the exemplary embodiment of the present disclosure may include a catching protrusion 40.

The catching protrusion 40 may be formed inside the valve cover member 10. In addition, the catching protrusion 40 is disposed to be spaced apart from the dissolving drain port 312 of the valve cover member 10, and may protrude toward the valve member 20. Further, the catching protrusion 40 supports an inner circumferential surface of the other side of the elastic member 30, and may prevent the elastic member 30 from being withdrawn from a position between the valve cover member 10 and the elastic member 30 when the elastic member 30 is extended and contracted.

That is, the catching protrusion 40 supports an inner circumferential surface of the elastic member 30, such that the elastic member 30 may be effectively positioned inside the valve cover member 10.

As illustrated in FIG. 3, the valve cover member 10 of the dissolving unit 300 according to the exemplary embodiment of the present disclosure may further include a valve rib 12.

The valve rib 12 may be formed in the valve cover member 10. In addition, the valve rib 12 may be disposed between the catching protrusion 40 and a cover outer wall 11 which is coupled to the outer circumferential surface of the valve accommodating protrusion 351. Specifically, the valve cover member 10 includes the cover outer wall 11, which has screw threads formed on the inner circumferential surface to be coupled to the outer circumferential surface of the valve accommodating protrusion 351, and the dissolving drain port 312 which is formed at a central portion of the valve cover member 10.

The valve rib 12 is formed on the valve cover member 10, and may circularly protrude between the dissolving drain port 312 and the cover outer wall 11 toward the outer body 310 or the valve member 20 along the center of the dissolving drain port 312. In addition, the valve rib 12 may be disposed between the catching protrusion 40 and the cover outer wall. That is, the valve rib 12 may be disposed relatively farther from the dissolving drain port 312 than the catching protrusion 40. In addition, the valve accommodating protrusion 351 may be disposed between the valve rib 12 and the cover outer wall 11.

The discharge check valve 350 of the dissolving unit 300 according to an exemplary embodiment of the present disclosure may further include a first sealing member 60.

The first sealing member 60 may be installed between the cover outer wall 11 and the valve rib 12. In addition, the first sealing member 60 may maintain a watertight seal between the valve accommodating protrusion 351 and the valve cover member 10. Specifically, one surface of the first sealing member 60 disposed between the valve rib 12 and the cover outer wall 11 may come into contact with the valve accommodating protrusion 351. Therefore, it is possible to effectively prevent water, which passes through the dissolving drain port 312 through the drain hole 315, from leaking between the cover outer wall 11 and the outer circumferential surface of the valve accommodating protrusion 351.

The first sealing member 60 may effectively prevent the air stored in the dissolving unit 300 from leaking outside of the dissolving unit 300.

The outer body 310 of the dissolving unit 300 according to an exemplary embodiment of the present disclosure may further include support protrusions 352.

The support protrusions 352 may be formed on the outer body 310. In addition, the support protrusions 352 may be formed on an outer circumference of the other side of the outer body 310 with respect to the drain hole 315. Further, the support protrusions 352 protrude on the outer circumference of the outer body 310 in the longitudinal direction of the outer body 310, and a plurality of support protrusions 352 may be disposed such that they are spaced apart from each other with respect to the drain hole 315.

Specifically, the support protrusions 352 may be disposed to face the other end portion of the valve member 20. In addition, when the valve member 20 opens the drain hole 315, the support protrusions 352 may effectively inhibit the other end portion of the valve member 20, which is formed with a diameter relatively larger than the diameter of the drain hole 315, from closing the drain hole 315.

That is, when the valve member 20 opens the drain hole 315, the other end portion of the valve member 20 comes into contact with one surface of the support protrusions 352, and the plurality of support protrusions 352 may guide water passing through the drain hole 315 so that the water passes between the plurality of support protrusions 352.

As illustrated in FIG. 3, the discharge check valve 350 according to the exemplary embodiment of the present disclosure may further include a second sealing member 50.

The second sealing member 50 may be disposed between one surface of the outer body 310 and one surface of the cover outer wall 11, which faces one surface of the outer body 310. Specifically, the second sealing member 50 is inserted and disposed into an accommodating groove formed in one surface that faces the outer body 310 of the cover outer wall 11, and may effectively maintain an airtight seal between the outer body 310 and the valve cover member 10.

As illustrated in FIG. 1, the dissolving unit 300 according to an exemplary embodiment of the present disclosure may include an inner body 320, a porous portion 321, and an inner hole 322.

Like the outer body 310, one side of the inner body 320 may be opened, and the other side may be formed in a hemispheric shape. In addition, the inner body 320 may be disposed inside the outer body 310. Further, an outer circumferential surface of the inner body 320 may be disposed such that it is spaced apart from an inner circumferential surface of the outer body 310 to form a dissolving flow path. Specifically, one side of the inner body 320 may be supported by one side of the outer body 310.

That is, one side of the inner body 320 is supported by one side of the outer body 310, and the outer circumferential surface of the inner body 320 may be disposed such that it is spaced apart from the inner circumferential surface of the outer body 310 to form the dissolving flow path.

The porous portion 321 may be formed in one area of the inner body 320. The porous portion 321 may guide at least a part of the water introduced into the inner body 320 through the dissolving inlet port 331 so that at least a part of the water collides with water newly introduced into the dissolving inlet port 331 and which water flows into the dissolving flow path. In addition, the porous portion 321 may be formed in one area at one side of the inner body 320 or one area of the outer circumferential surface of the inner body 320. Specifically, the porous portion 321 may be formed in one area of the inner body 320 which is relatively near to the dissolving inlet port 331. As an example, the porous portion 321 may have a plurality of holes formed in a circumferential direction of the inner body 320. That is, the porous portion 321 may be formed at an upper side of the inner body 320 and disposed to be adjacent to the dissolving inlet port 331.

In other words, the water introduced into the dissolving inlet port 331 formed in the dissolving cap 330 may flow into the interior of the inner body 320, and may flow from the interior of the inner body 320 through the porous portion 321 along the dissolving flow path in a direction in which a distance from the dissolving inlet port 331 is increased. Specifically, the water supplied into the dissolving inlet port 331 formed in the dissolving cap 330 may be mixed with the air stored in the dissolving unit 300 while flowing into the inner body 320 and along the dissolving flow path formed between the inner body 320 and the outer body 310, thereby dissolving the stored air in the water introduced from the dissolving inlet port 331.

It is appreciated that, without a separate agitating device or a separate mixing member, water introduced into the dissolving inlet port 331 of the dissolving unit 300 may be effectively mixed with the air stored in the dissolving unit 300 while flowing into the interior of the inner body 320 in the dissolving unit 300 and along the dissolving flow path.

The inner hole 322 may be formed at the other hemispheric side of the inner body 320. The inner hole 322 may be formed to have an area relatively smaller than the opened area at one side of the inner body 320.

Figure 5:
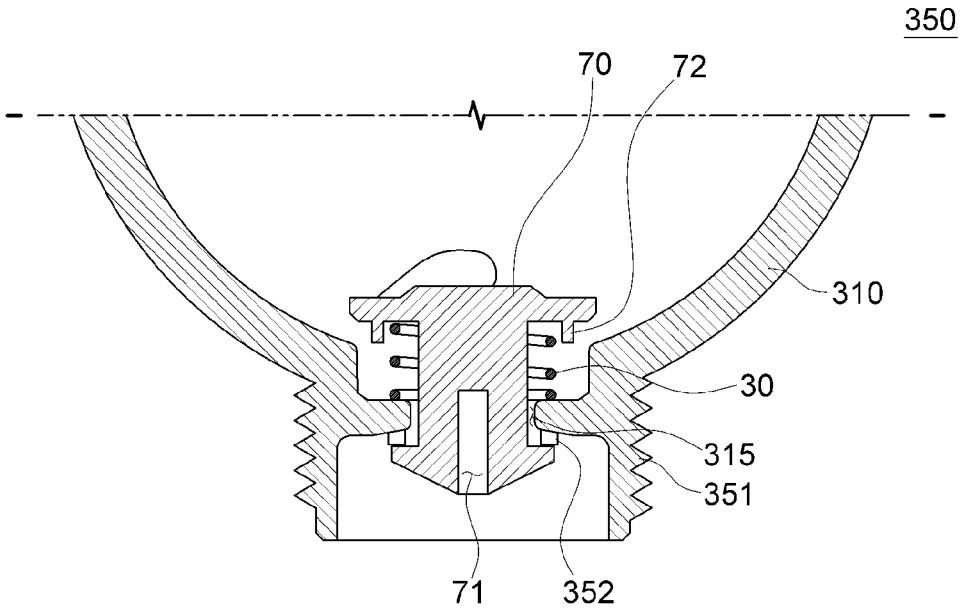
FIG. 5 is a view illustrating a valve member according to another exemplary embodiment of the present disclosure.

Alternatively, as illustrated in FIG. 5, the dissolving unit 300 according to an exemplary embodiment of the present disclosure may include the discharge check valve 350 that includes a valve member 70 according to another exemplary embodiment which is different from the valve member 20.

As illustrated in FIG. 5, the discharge check valve 350 according to another exemplary embodiment of the present disclosure may include the valve member 70 and the elastic member 30. The valve member 70 may include a deformable elastic material such as rubber, for instance, but any other well known deformable elastic material could be used.

One end portion of the valve member 70 is inserted and disposed into the drain hole 315, and a diameter of the one end portion of the valve member 70 is relatively larger than the diameter of the drain hole 315. In addition, the other end portion of the valve member 70 may be disposed outside of the drain hole 315. Further, a diameter of the other end portion of the valve member 70 may be relatively larger than the diameter of the drain hole 315. Specifically, the diameter of one end portion of the valve member 70 may be relatively larger than the diameter of the other end portion of the valve member 70.

That is, the valve member 70 according to another exemplary embodiment of the present disclosure may be assembled such that it penetrates the drain hole 315 from the interior of the outer body 310. Specifically, a valve hollow portion 71 may be formed at a center of the other end portion of the valve member 70. Therefore, the other end portion of the valve member 70, which is formed to be relatively larger than the diameter of the drain hole 315, is easily deformed by the valve hollow portion 71, and therefore the valve member 70 penetrates the drain hole 315 such that it is disposed outside the drain hole 315.

The elastic member 30 may be disposed between the drain hole 315 and the one end portion of the valve member 70. In addition, the elastic member 30 may provide elastic force to the valve member 70. Specifically, the elastic member 30 is extended when the valve member 70 opens the drain hole 315, and conversely the elastic member 30 may be compressed when the valve member 70 closes the drain hole 315. That is, the elastic member 30 may provide elastic force so that the valve member 70 opens and closes the drain hole 315.

A catching rib 72, which prevents withdrawal of the elastic member 30, may be formed on one end portion of the valve member 70 according to another exemplary embodiment of the present disclosure. Specifically, the catching rib 72 may circularly protrude around a center of the valve member 70 at one end of the elastic member 30 in a direction toward the drain hole 315.

Therefore, an outer circumferential surface of the elastic member 30 is supported by the catching rib 72, such that the elastic member 30 may effectively provide elastic force to the valve member 70 when the elastic member 30 is extended and contracted.

Although not illustrated, the valve member 70 according to another exemplary embodiment of the present disclosure may also be installed together with the cover member and the first sealing member 60 similar to the discharge check valve 350 of the dissolving unit 300 according to one exemplary embodiment of the present disclosure.

Hereinafter, an operational process of the washing machine 101 having the dissolving unit 300 including the discharge check valve 350 according to the exemplary embodiment of the present disclosure will be described with reference to FIGS. 1 to 4, and 6.

Figure 6:
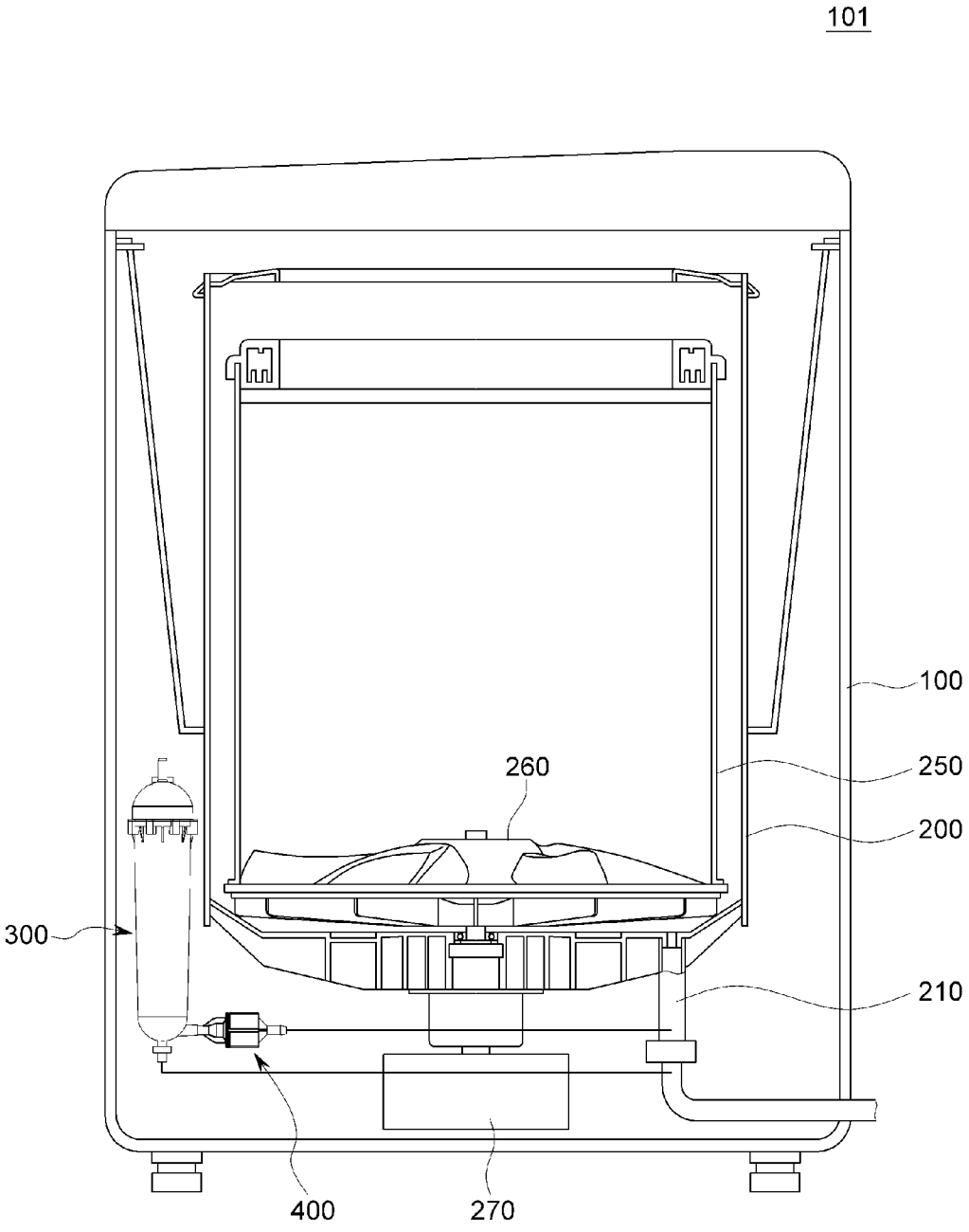
FIG. 6 is a view illustrating a washing machine having a dissolving unit installed therein according to an exemplary embodiment of the present disclosure.

As illustrated in FIG. 6, the washing machine 101 according to the exemplary embodiment of the present disclosure may include: a housing 100; a tub 200 (which is disposed in the housing 100 and stores washing water); a washing tub 250 (which is disposed in the tub 200 and accommodates laundry); a pulsator 260 which is disposed in the washing tub 250; a drive unit 270 which drives the pulsator 260 and the washing tub 250 (so that the pulsator 260 and the washing tub 250 may be rotated); the dissolving unit 300; and a bubble generating unit 400 which is supplied with the water in which air is dissolved by the dissolving unit 300, generates bubbles using the water, and supplies the bubbles into the tub 200.

In addition, the dissolving unit 300 may further include a dissolving guide port 311 which supplies the water with dissolved air to the bubble generating unit 400. Specifically, the dissolving guide port 311 may protrude in an outer circumferential direction of the outer body 310. In addition, the drain hole 315 may be formed at a position relatively lower than the dissolving guide port 311 in the longitudinal direction of the outer body 310 so that any water remaining in the outer body 310 is readily discharged to the outside.

The bubble generating unit 400 may include a bubble body 410, a bubble nozzle 420, a pressure reduction region 440, and a bubble check valve 430.

The bubble body 410 may include a bubble inlet port 411 and a bubble discharge port 412. Specifically, the bubble inlet port 411 may be formed at one side of the bubble body 410 and connected with the dissolving guide port 311. The bubble discharge port 412 may be formed at the other side of the bubble body 410.

The bubble nozzle 420 may be disposed inside the bubble body 410. The bubble nozzle 420 may be formed with a bubble flow path 421 which is formed with an increasing inner diameter from the bubble inlet port 411 to the bubble discharge port 412. Specifically, the water with dissolved air, which is introduced into the bubble inlet port 411, may be deaerated while passing through the bubble flow path 421, thereby advantageously generating bubbles.

As an example, a single or a plurality of bubble flow paths 421 may be formed in the bubble nozzle 420. That is, one or more bubble flow paths 421 may be formed in the bubble nozzle 420.

Therefore, with the bubble nozzle 420 having the bubble flow path 421, the bubble generating unit 400 may effectively generate bubbles by using the water with dissolved air.

The pressure reduction region 440 may be formed in the bubble body 410 located between the bubble nozzle 420 and the bubble discharge port 412. In addition, the pressure reduction region 440 may be formed with a relatively larger diameter than one side of the bubble flow path 421 which is relatively closer to the bubble discharge port 412 than the bubble inlet port 411. As an example, in a case in which a plurality of bubble flow paths 421 is formed, the interior of the bubble body 410 (having the pressure reduction region 440) may be formed with a diameter relatively larger than a sum of the sizes of one side of the plurality of bubble flow paths 421.

Pressure of the bubbles generated while passing through the bubble flow path 421 is reduced in the pressure reduction region 440, and the bubbles may be supplied into the tub 200 through the bubble discharge port 412. Specifically, the bubbles may be supplied through the bubble flow path 421 via a drain line 210 of the tub 200. As an example, the bubble flow path 421 may be connected with an upper portion of the drain line 210 instead of a drain valve 500 which is installed in the drain line 210 and may selectively discharge the washing water in the tub 200. Therefore, the bubbles may be effectively supplied into the tub 200 when the drain valve 500 closes the drain line 210.

The bubble check valve 430 may be disposed between the bubble inlet port 411 in the bubble body 410 and the bubble nozzle 420. In addition, the bubble check valve 430 may guide the water with dissolved air so that the water with dissolved air is supplied from the bubble inlet port 411 to the bubble nozzle 420. Further, the bubble check valve 430 may block a fluid flow that is introduced into the bubble inlet port 411 from the bubble discharge port 412.

That is, the bubble check valve 430 opens the bubble inlet port 411 by pressure from the water with dissolved air, and the bubble check valve 430 may guide the water with dissolved air, which is introduced into the bubble inlet port 411, so that the water with dissolved air passes through the bubble flow path 421 formed in the bubble nozzle 420. Further, when the fluid is supplied from the bubble discharge port 412 and moves to the bubble inlet port 411, the bubble inlet port 411 is closed to prevent the fluid from being supplied into the dissolving unit 300.

The dissolving unit 300 according to the exemplary embodiment of the present disclosure may further include an air supply check valve 340.

The air supply check valve 340 may be installed on the dissolving cap 330. Specifically, the air supply check valve 340 is installed on the dissolving cap 330 in order to be spaced apart from the dissolving inlet port 331. In addition, the air supply check valve 340 is opened when the water is discharged outside of the dissolving unit 300 through the dissolving drain port 312, thereby allowing the outside air to flow into the inner body 320 and the outer body 310 of the dissolving unit 300. Specifically, the air supply check valve 340 is opened when the pressure in the dissolving unit 300 is equal to or lower than a preset pressure, thereby filling the interior of the dissolving unit 300 with air. That is, the air is not supplied from a separate tank or pump, which stores air, to the dissolving unit 300, but rather the air supply check valve 340 is opened and closed by pressure in the dissolving unit 300, thereby filling the interior of the dissolving unit 300 with air.

The water may be effectively discharged through the dissolving drain port 312 by pressure of air introduced through the air supply check valve 340.

The washing water is supplied into the tub 200 in a washing cycle or a rinsing cycle of the washing machine 101. Specifically, the washing water is supplied to an upper portion of the tub 200 and to the dissolving unit 300. The washing water supplied into the dissolving unit 300 is mixed with the air stored in the dissolving unit 300.

That is, the water supplied into the dissolving unit 300 flows along the interior of the dissolving unit 300 so that air stored in the dissolving unit 300 is dissolved in the water. Specifically, the water introduced through the dissolving inlet port 331 flows into the inner body 320 and is stored in a hollow interior of the inner body 320. In this case, 1) the water, which is continuously supplied through the dissolving inlet port 331, and 2) the water, which is stored in the hollow interior of the inner body 320, collide with each other, flow along the inner wall of the inner body 320, and flow over toward the dissolving flow path located between the inner circumferential surface of the outer body 310 and the outer circumferential surface of the inner body 320 through the porous portion 321 formed in one area of the inner body 320 and disposed adjacent to the opened one side of the inner body 320.

Therefore, the water introduced into the dissolving unit 300 flows into the inner body 320 and along the dissolving flow path between the inner body 320 and the outer body 310, and is effectively mixed with the air stored in the dissolving unit 300 without need of a separate pump or an agitating device, thereby allowing air to be dissolved in the water introduced into the dissolving inlet port 331.

The water with dissolved air in the dissolving unit 300 may be supplied into the bubble generating unit 400 through the dissolving guide port 311. Specifically, in the dissolving guide port 311, the water with dissolved air, which is supplied into the bubble generating unit 400, passes through the nozzle formed in the bubble generating unit 400, such that the air included in the water with dissolved air is separated, thereby advantageously generating bubbles (micro bubbles). As an example, a diameter of the nozzle (through which the water with dissolved air introduced into the bubble generating unit 400 passes) is smaller than a diameter of the nozzle through which the water is discharged to the bubble generating unit 400, thereby generating bubbles in the bubble generating unit 400.

It is appreciated that the bubbles, which are generated as described above, are supplied into the tub 200 to advantageously reduce surface tension between detergents or foreign substances remaining on surfaces of laundry, thereby allowing the laundry to be effectively washed.

The washing machine 101 according to an exemplary embodiment of the present disclosure may further include a water level sensor and a control unit. Specifically, sensors for detecting a flow rate or a level of water supplied into the tub 200 may be further included. The control unit may determine whether a preset or larger amount of water is supplied into the tub 200 based on the current level of the water in the tub 200 which is detected by the sensor, and based on the detected level of water supplied into the tub 200 from outside.

That is, when a preset amount of water is supplied into the tub 200, the control unit blocks the supply of water supplied into the dissolving unit 300 from outside. In this case, the water with dissolved air, which remains in the dissolving unit 300, is supplied into the bubble generating unit 400 through the dissolving guide port 311.

Specifically, the water with dissolved air which remains in the dissolving unit 300, which cannot open the bubble check valve 430 due to its pressure or its level, is discharged to the outside of the dissolving unit 300 through the dissolving drain port 312 as illustrated in FIG. 3.

That is, after the supply of the water supplied through the dissolving inlet port 331 is blocked, the water, which cannot be supplied into the bubble generating unit 400, remains in the dissolving unit 300 at a low level. In this case, the water, which remains in the inner body 320 through the inner hole 322 formed at the other hemispheric side of the inner body 320, is collected in the dissolving flow path located between the other hemispheric side of the inner body 320 and the other hemispheric side of the outer body 310.

The discharge check valve 350, which is disposed at the other hemispheric side of the outer body 310, is opened based on the level (pressure) of the water remaining in the dissolving unit 300. That is, the discharge check valve 350 opens the drain hole 315.

In a case in which the level or the pressure of the water remaining in the dissolving unit 300 cannot press and compress the elastic member 30 of the discharge check valve 350 any further, the elastic member 30 is extended in a direction in which the elastic member 30 becomes adjacent to the drain hole 315 in the longitudinal direction of the valve member 20. In such case, the drain hole 315 is opened by the valve member 20. In this case, the support protrusions 352 come into contact with the other end portion of the valve member 20, thereby maintaining the opened state of the drain hole 315.

The water, which passes through the drain hole 315 and is discharged to the outside of the outer body 310, passes through the plurality of support protrusions 352, and then is discharged to the outside through the dissolving drain port 312 as illustrated in FIGS. 3 and 6. Specifically, the dissolving drain port 312 is connected to the drain line 210 and piping installed at a lower side of the tub 200, and as a result, the water discharged to the outside of the dissolving unit 300 may be discharged to the outside of the washing machine 101 through the drain line 210. Specifically, the dissolving drain port 312 may be connected with a lower portion lower than the drain valve 500 installed in the drain line 210.

When the discharge check valve 350 opens the drain hole 315, internal pressure of the dissolving unit 300 is reduced to a preset pressure or lower, and in this case, the air supply check valve 340 may be opened to fill the interior of the dissolving unit 300 with outside air. In addition, with the opened air supply check valve 340, the residual water may be more effectively discharged through the drain hole 315.

Figure 4:
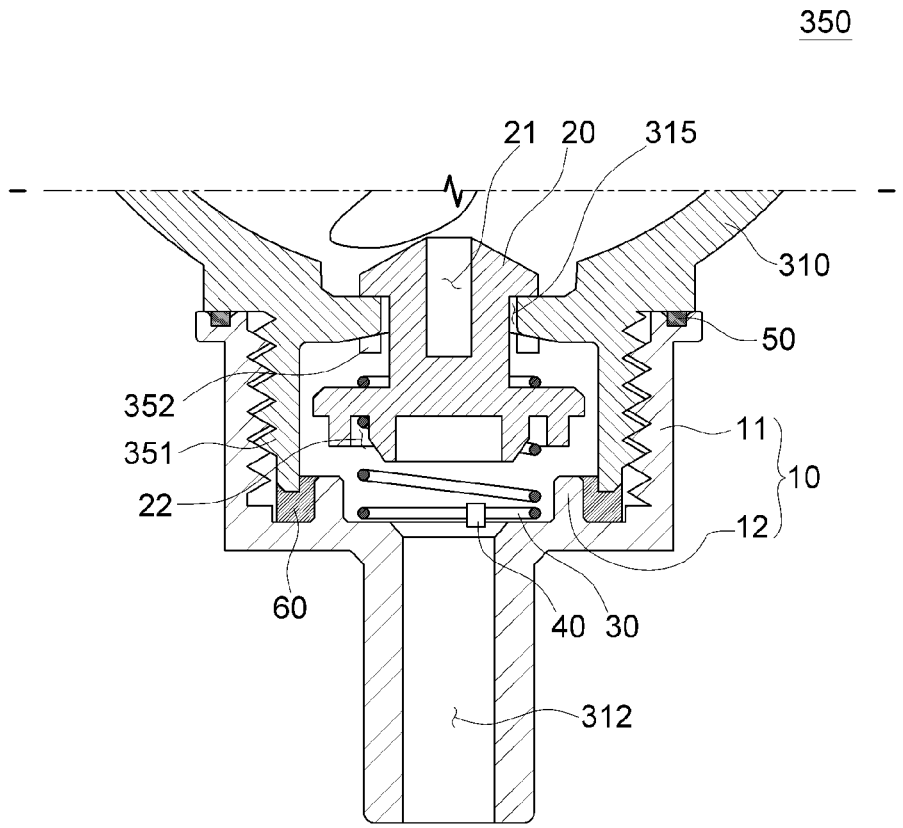

When the water is supplied again from the outside through the dissolving inlet port 331 by the control unit, the valve member 20 is moved in a direction in which the elastic member 30 is compressed in the longitudinal direction of the valve member 20 by pressure from the water introduced into the dissolving unit 300 as illustrated in FIG. 4. Further, the valve member 20 closes the drain hole 315. In this case, when the pressure in the dissolving unit 300, which is formed by the air stored in the dissolving unit 300 or the water flowing into the dissolving unit 300, reaches the preset pressure or higher, the air supply check valve 340 stops the interior of the dissolving unit 300 from being filled with air.

With the aforementioned configurations, the dissolving unit 300 installed in the washing machine 101 according to an exemplary embodiment of the present disclosure advantageously includes the discharge check valve 350, and as a result, it is possible to effectively prevent the dissolving unit 300 from being frozen, which may occur when water remains in the dissolving unit 300 during the winter, for instance. In addition, the discharge check valve 350 may be opened and closed in accordance with the level or the amount of water in the dissolving unit 300, and as a result, it is possible to effectively open and close the drain hole 315 without a separate electric device. Further, the discharge check valve 350 may be assembled outside of the outer body 310, and as a result, maintenance of the discharge check valve 350 may be easily performed.

Hereinafter, the washing machine 101 including the dissolving unit 300 having the discharge check valve 350 including the valve member 70 according to another exemplary embodiment of the present disclosure will be described with reference to FIGS. 5 and 6.

A point in time at which the discharge check valve 350 according to another exemplary embodiment of the present disclosure operates is identical to that of the discharge check valve 350 according to the exemplary embodiment of the present disclosure.

However, the processes in which the discharge check valve 350 and the outer body 310 according to another exemplary embodiment of the present disclosure are coupled and operated are different from those of the discharge check valve 350 according to the exemplary embodiment of the present disclosure.

The discharge check valve 350 according to another exemplary embodiment of the present disclosure has the elastic member 30 and the valve member 70 installed in the outer body 310, and in this case, the other end portion of the valve member 70 is easily deformed by external force and by the valve hollow portion 71, and inserted into and installed outside the drain hole 315. Further, the discharge check valve 350 according to another exemplary embodiment of the present disclosure may also include the valve cover member 10, the first sealing member 60, and the second sealing member 50 which are included in the discharge check valve 350 according to one exemplary embodiment of the present disclosure.

Therefore, when one end portion of the valve member 70 is pressed, in accordance with the level of the water remaining in the outer body 310, one end portion of the valve member 70 may close the drain hole 315 by pressing the elastic member 30. In addition, when the amount of water remaining in the outer body 310 is equal to or smaller than a preset amount, the elastic member 30 is extended, and the valve member 70 is moved in the longitudinal direction of the valve member 70 in a direction in which the other end portion of the valve member 70 becomes adjacent to the drain hole 315, thereby opening the drain hole 315. In this case, the water passing through the drain hole 315 may pass through the plurality of support protrusions 352 and may be discharged into the dissolving drain port 312.

With the aforementioned configurations, the discharge check valve 350 including the valve member 70 according to another exemplary embodiment of the present disclosure may be effectively assembled from the inside of the outer body 310 to the outside of the outer body 310.

While the exemplary embodiments of the present disclosure have been described with reference to the accompanying drawings, those skilled in the art will understand that the present disclosure may be implemented in any other specific form without changing the technical spirit or an essential feature thereof Accordingly, it should be understood that the aforementioned exemplary embodiment is described for illustration in all aspects and is not limited, and the scope of the present disclosure shall be represented by the claims to be described below, and it should be construed that all of the changes or modified forms induced from the meaning and the scope of the claims, and an equivalent concept thereto are included in the scope of the present disclosure.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A washing machine comprising a dissolving unit operable to store air therein and to be supplied with water from outside, wherein the dissolving unit comprises:

an outer body having a hollow interior, and comprising: one side formed to be opened; and another side with a drain hole; and a valve accommodating protrusion surrounding the drain hole and protruding outside of the outer body in a longitudinal direction and further protruding in one area of the another side of the outer body;

an inner body disposed inside the outer body;

a dissolving cap coupled to the one side of the outer body and configured to store air therein, said dissolving cap comprising a dissolving inlet port configured to supply water into the inner body; and a discharge check valve installed at the other side of the outer body, and configured to open and close the drain hole, wherein the discharge check valve comprises:

a valve member having one end portion inserted into the drain hole, and another end portion disposed in the valve accommodating protrusion;

a valve cover member detachably coupled to an outer circumferential surface of the valve accommodating protrusion, and having a dissolving drain port operable to guide water passing through the drain hole and discharged outside of the outer body; and an elastic member disposed between the valve member and the valve cover member, and operable to provide an elastic force to the valve member.

2. The washing machine of claim 1, wherein the valve member comprises a valve hollow portion formed at a center of the one end portion inserted into the drain hole, wherein an outer diameter of the one end portion is larger than a diameter of the drain hole.

3. The washing machine of claim 1, wherein an outer diameter of the another end portion of the valve member, disposed in the valve accommodating protrusion, is larger than a diameter of the drain hole, and wherein the valve member comprises a support groove formed at the another end portion to support the elastic member.

4. The washing machine of claim 1, wherein the valve cover member comprises a catching protrusion spaced apart from the dissolving drain port and configured to support the elastic member.

5. The washing machine of claim 4, wherein the valve cover member further comprises a valve rib disposed between the catching protrusion and a cover outer wall of the valve cover member coupled to an outer circumferential surface of the valve accommodating protrusion and wherein the valve rib protrudes toward the outer body relative to the dissolving drain port.

6. The washing machine of claim 5, wherein the discharge check valve further comprises a first sealing member disposed between the cover outer wall and the valve rib, wherein the discharge check valve is operable to maintain a watertight seal between the valve accommodating protrusion and the valve cover member.

7. The washing machine of claim 6, wherein the outer body comprises support protrusions which face the another end portion of the valve member, and are spaced apart from each other relative to the drain hole, and further protrude in the longitudinal direction of the outer body, and support an opened state of the drain hole.

8. The washing machine of claim 1, wherein the outer body comprises support protrusions which face the another end portion of the valve member, and are spaced apart from each other relative to the drain hole, and further protrude in the longitudinal direction of the outer body, and support an opened state of the drain hole.

9. The washing machine of claim 1, wherein the inner body is opened at one side and wherein an outer circumferential surface of the inner body is spaced apart from an inner circumferential surface of the outer body to form a dissolving flow path and further comprising:

a porous portion formed in one area of the inner body; and an inner hole formed at an another side of the inner body and operable to guide water remaining in the inner body to be discharged to the drain hole.

* * * * *